United States Patent [19]

Cellerini et al.

[11] 3,950,716

[45] Apr. 13, 1976

[54] MULTI-POLE CIRCUIT BREAKER WITH ADJUSTABLE THERMAL TRIP UNIT

[75] Inventors: Albert R. Cellerini; Paul Skalka; William I. Stephenson, Jr., all of Beaver, Pa.

[73] Assignee: Westinghouse Electric Corporation, Pittsburgh, Pa.

[22] Filed: Feb. 21, 1975

[21] Appl. No.: 551,936

[52] U.S. Cl. ..... 335/45; 335/176; 337/82

[51] Int. Cl.[2] ..... H01H 75/08

[58] Field of Search ..... 337/50, 57, 94, 82; 335/42, 45, 23, 176

[56] References Cited

UNITED STATES PATENTS

| | | | |
|---|---|---|---|
| 3,211,861 | 10/1965 | Freese | 337/82 X |
| 3,240,903 | 3/1966 | Groves et al. | 337/82 X |
| 3,345,591 | 10/1967 | Leonard et al. | 335/23 |
| 3,758,887 | 9/1973 | Ellsworth et al. | 335/42 X |
| 3,775,713 | 11/1973 | Walker et al. | 335/45 X |

*Primary Examiner*—G. Harris
*Attorney, Agent, or Firm*—L. P. Johns

[57] ABSTRACT

A multi-pole circuit breaker with adjustable thermal trip unit characterized by a circuit breaker mechanism having a plurality of pole units, means releasable when released from a latched position to effect simultaneous opening of the circuit breaker contacts, a multi-pole trip device including trip means for each of said pole units, each of said trip means being constructed to operate upon the occurrence of certain current conditions to effect release of said releasable means, and each pole unit comprising a bimetal element responsive to current flow to effect heating thereof. The circuit breaker also comprises a first trip bar and a second trip bar, the first trip bar being mounted to oscillate between latched and unlatched positions and being biased in the latched position, the second trip bar being pivotally mounted on the first trip bar at spaced locations between the ends of the first trip bar and being pivotally adjustable to varying spacings from the bimetal elements, and an adjusting cam mounted on the first trip bar and engageable with the second trip bar for adjusting the second trip bar with respect to the bimetal elements.

6 Claims, 7 Drawing Figures

MULTI-POLE CIRCUIT BREAKER WITH ADJUSTABLE THERMAL TRIP UNIT

CROSS REFERENCE TO RELATED APPLICATION

This invention is related to that disclosed in the application of Albert R. Cellerini and Louise N. Ricci, Ser. No. 551,937, filed Feb. 21, 1975.

BACKGROUND OF THE INVENTION

1. Field of the Invention

This invention relates, generally, to circuit breakers and, more particularly, to circuit breakers having adjustable thermal trip means.

2. Description of the Prior Art

The conventional thermal tripping mechanism of a circuit breaker is well known in the art and consists mainly of a movable trip bar which carries a releasable latch. As shown in U.S. Pat. No. 3,211,860, the trip bar is actuated by adjacent bimetal strips which respond to temperature generated by the current flowing through the circuit breaker. A difficulty with some circuit breakers of the type shown in that patent, is the problem of precisely resetting an adjusting screw of one pole to correspond with settings of corresponding screws for the other poles in the circuit breaker so that all screws are engaged by a corresponding bimetal element for the same current rating.

SUMMARY OF THE INVENTION

It has been found that in accordance with this invention, that the foregoing problem may be overcome by providing a multi-pole circuit breaker comprising a circuit breaker mechanism having a plurality of pole units, each pole unit comprising a pair of contacts, means releasable when released from a latched position to effect simultaneous opening of all of said pairs of contacts, a multi-pole trip device comprising trip means for each of said pole units, each of said trip means being constructed to operate upon the occurrence of certain current conditions to effect release of said releasable means, such pole unit comprising a bimetal element responsive to current flow to effect heating thereof, trip bar means movable to unlatch the releasable means and being biased in the latched position, the trip bar means comprising a first trip bar and a second trip bar, the first trip bar being mounted to oscillate between latched and unlatched positions, the second trip bar being pivotally mounted at spaced locations between the ends of and on said first trip bar and being pivotally adjustable to varying spacings from the bimetal elements, and adjustment means comprising a cam on the first trip bar and engageable with the second trip bar for moving the second trip bar with respect to the bimetal elements.

The advantage of the device of this invention is that the thermal rating can be varied from 100 to 70% by turning the adjusting cam.

DESCRIPTION OF THE PREFERRED EMBODIMENT

Figure 1:
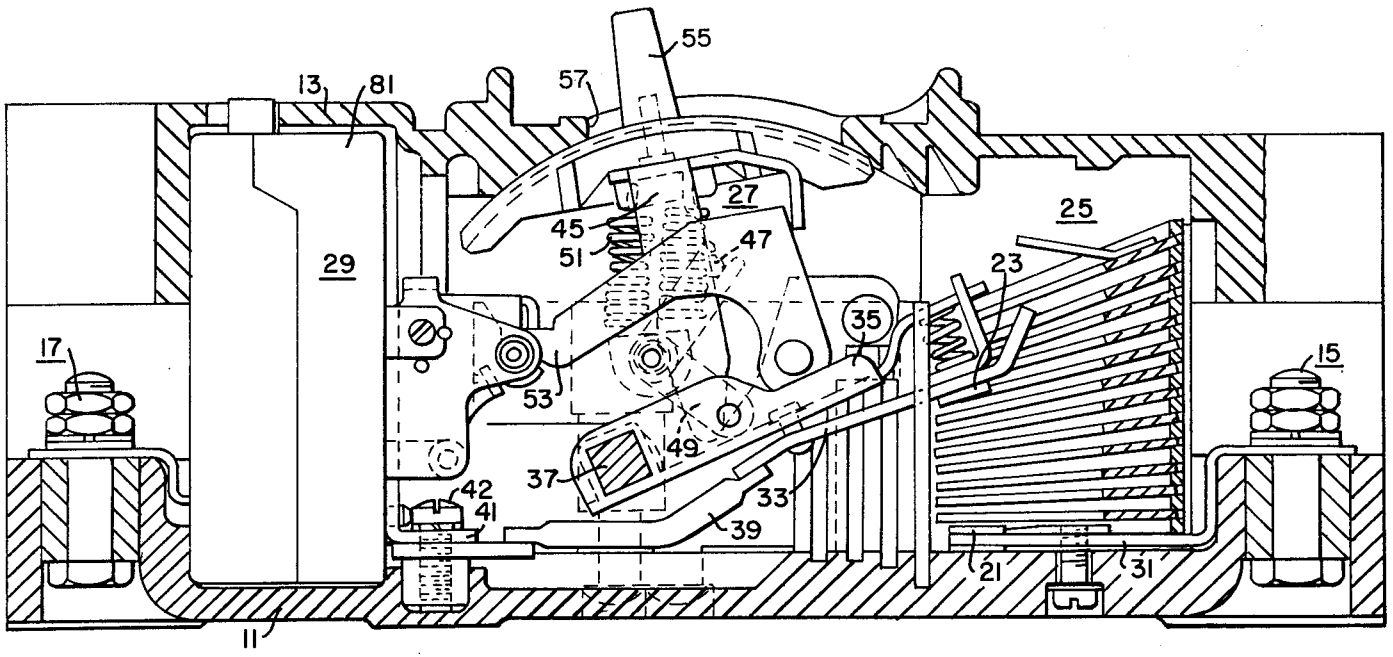
FIG. 1 is a vertical sectional view of a circuit breaker shown in the open position.

In FIG. 1, the circuit breaker shown therein is of the three-pole type and comprises generally a base 11 and a removable cover 13, both of which may be molded from suitable electrically insulating material. Inasmuch as a detailed description of the circuit breaker is set forth in U.S. Pat. No. 3,211,860, the description of the circuit breaker portion is limited to the parts that are essential to the operation of the invention disclosed herein.

Each of the three-poles is provided with terminals at opposite ends of the base 11 indicated generally at 15 and 17. The circuit breaker includes a stationary contact 21, a movable contact 23, and an arc extinguisher indicated generally at 25, for each pole unit. A common operating mechanism generally indicated at 27 is provided for simultaneously actuating the three movable contacts to open and closed positions. A trip device generally indicated at 29 automatically opens the contacts 21, 23 in response to predetermined overload conditions in a circuit through any pole unit of the breaker.

The terminal 15 is disposed at the outer end of a conducting strip 31 that extends into the housing and rigidly supports the stationary contact 21. The movable contact 23 for each pole unit is mounted on a rigid contact arm 33 which is supported on a switch arm 35 secured to a tie bar 37 which extends across all of the pole units and supports all of the switch arms 35 for unitary movement to the open and closed positions. The contact arm 33 is connected by means of a flexible conductor 39 to an intermediate or trip unit thermal member or conductor 41 which is secured at one end thereof to the base 11 by a screw 42. The conducting member 41 extends through the trip unit 29 and is connected at its outer end to the terminal structure 17. Accordingly, a circuit through the circuit breaker extends from the terminal 17 through the conductors 41, 39, the contact arm 33, the contacts 21, 23, the conductor 31 to the terminal 15.

The operating mechanism 27 comprises a pivoted operating lever 45, a pair of toggle links 47, 49, overcenter spring means 51, and a pivoted releasable cradle or arm 53 which is controlled by the trip device 29. An integral handle 55 extends through an opening 57 in the cover 13 to enable manual operation of the breaker between OFF and ON positions.

Figure 2:
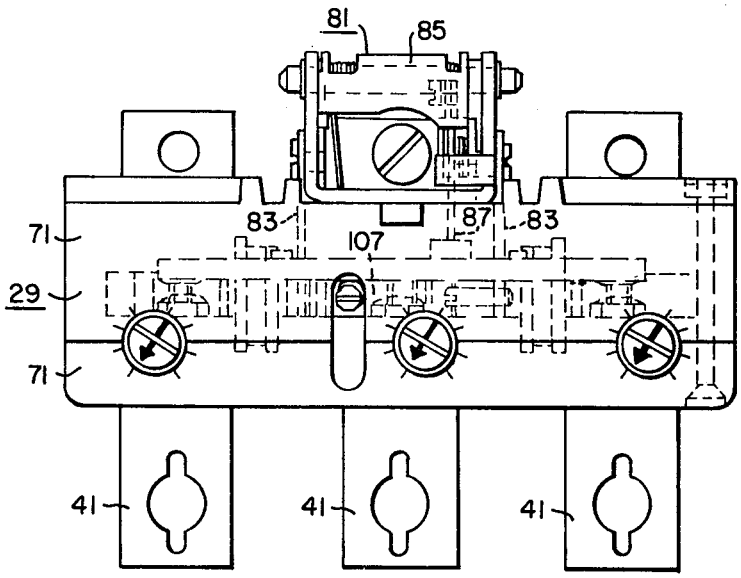
FIG. 2 is an enlarged plan view of the removable trip device of the breaker shown in FIG. 1.
Figure 3:
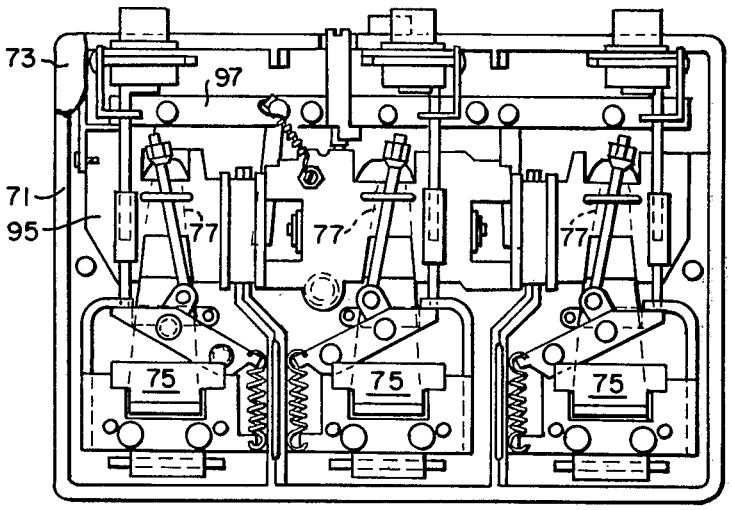
FIG. 3 is a front view with most of the cover broken away of the trip device.
Figure 4:
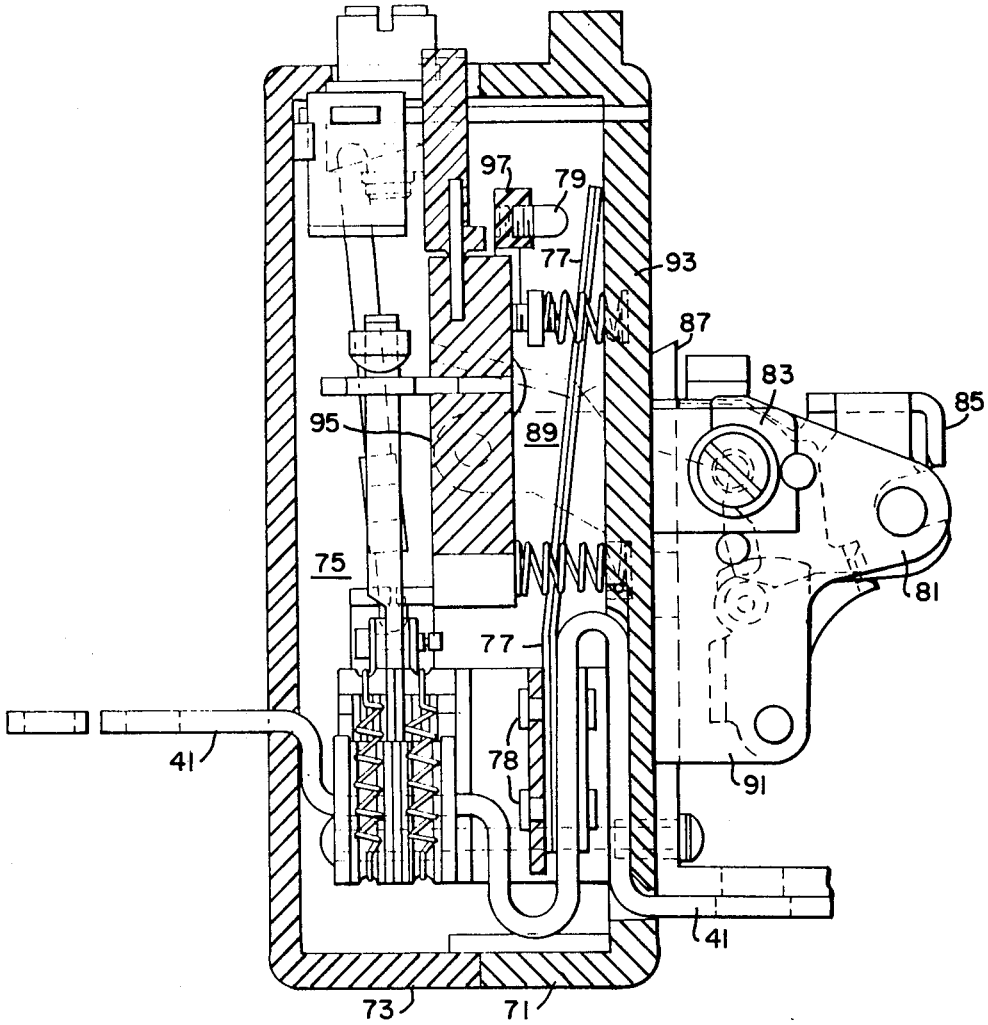
FIG. 4 is an enlarged sectional view taken on the lines IV—IV of FIG. 3.

As shown in FIGS. 2, 3 and 4, the trip device is contained within an electrically insulating housing comprising a base or support member 71 and a cooperating cover 73. The trip device 29 is similar to that set forth in U.S. Pat. No. 3,211,860, for which reason an abbreviated description is set forth herein. Similar electroresponsive tripping means, generally indicated at 75, are provided for each of the three pole units and function separately in response to any current overload carried by the corresponding conductor 41. A bimetallic element or bimetal 77 has one end secured by means of rivets 78 to one leg of the looped portion (FIG. 4) of the conductor 41. The other free end of each bimetal 77 is disposed adjacent an adjusting screw 79.

As shown in FIGS. 2 and 4, the trip device 29 also comprises a latching mechanism 81 disposed on the exterior side of the base 71. The latching mechanism comprises a pair of stationary mounting arms 83, a latch lever 85, and a trip lever 87. The latch lever 85 is pivotally mounted on the latching mechanism 81 and (FIG. 1) retains the cradle 53 in the latched position. The trip lever 87 retains the latch lever 85 in the unlatched position, as shown in FIGS. 1, 2 and 4, due to engagement of the trip lever with a trip member 89. The mounting arms 83 are secured to a mounting frame 91 and extend through an opening 93 in the base 71 into the interior of the trip compartment enclosed by the base 71 and the cover 73.

Figure 5:
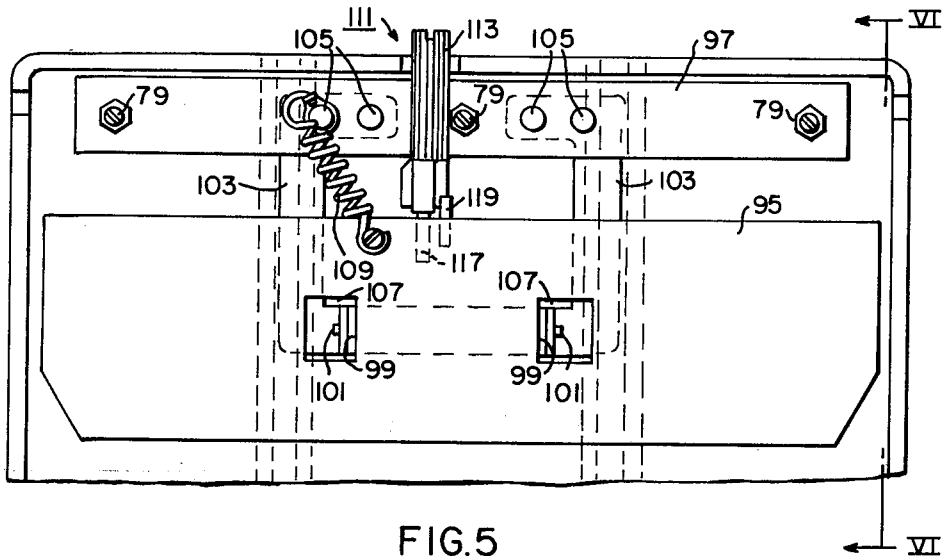
FIG. 5 is an enlarged view of the first and second trip bars.

In accordance with this invention, the trip device 29 comprises a first trip bar 95 and a second trip bar or trip arm 97. As shown in FIG. 5, the trip bar 95 includes a pair of spaced openings 99. The inner end portions of the mounting arm 83 extend into the openings 99 and the trip bar 95 is mounted on mounting pins 101 which extend into the openings from the trip bar 95. Thus, the trip bar is pivotally mounted in place for movement between tripped and untripped positions. The trip arm 97 is pivotally mounted on the trip bar 95 by means of metal brackets 103 at intermediate locations on the bar 95 and arm 97. More particularly, the brackets 103 are suitably secured such as by rivets 105 on the trip arm 97 and comprise outturned portions 107 that extend into the openings 99 where they are mounted on pins 101 which extend in opposite directions from the ends of the trip bar. Thus, the trip arm 97 is rotatably mounted on the trip bar 95.

Rotation of the trip arm 97 with respect to the trip bar 95 is influenced by biasing means, such as a coil spring 109, the upper ends of which are secured to the trip arm 97 and the lower ends of which are secured to the trip bar 95. The springs 109 retain the trip arm 97 in the desired position above the trip bar 95 as shown in FIG. 6.

Figure 6:
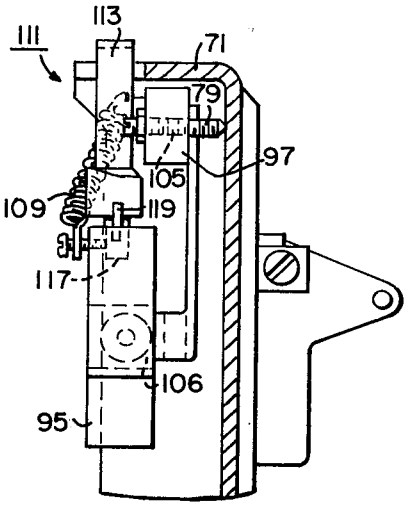
FIG. 6 is an end view of the trip bars as shown in FIG. 5.
Figure 7:
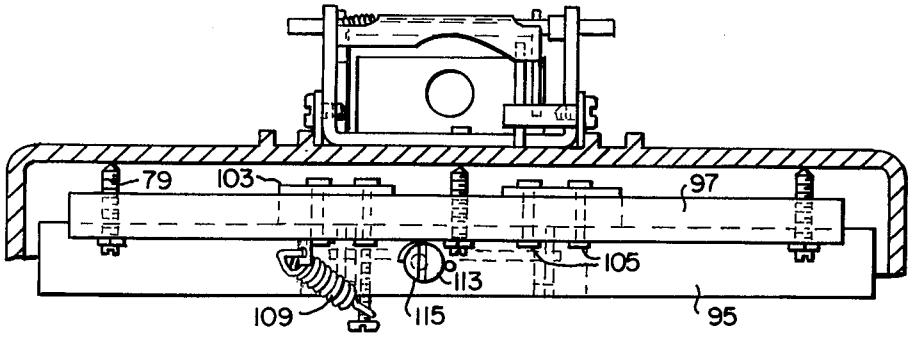
FIG. 7 is a plan view of a portion of the trip bars.

In addition to the springs 109 the trip arm 97 is subject to manipulation by adjustment means for rotating it through an angle $\alpha$ (FIG. 6). The adjustment means may comprise any one of a variety of movable members mounted on either the trip bar 95 or the trip arm 97 and extending over the surface of the other bar or arm for adjusting the angular movement of the arm with respect to the bar. The preferred adjusting means (FIGS. 5, 6 and 7) comprises a cam structure generally indicated at 111. The cam structure 111 comprises a rotatable eccentric shaft 113 that is mounted on a mounting pin 117 which is embedded in the trip bar 95. The cam structure 111 is rotated by inserting an implement, such as a screwdriver, into a slot 115 at the upper end of the shaft 113 so as to vary the angle $\alpha$ between the trip bar 95 and the trip arm 97 by rotating the shaft (FIG. 7) toward or away from the surface of the trip arm which is retailed against the cam by the spring 109.

As shown in FIG. 6, the lower end of the shaft 113 includes a projection 117 which limits the degree of rotation of the shaft by engaging a stop pin 119 that is seated in the bar 95. Thus, the cam travel is limited to the maximum and minimum of the eccentric differential of the cam surface with the true center of the shaft, or 180°.

In accordance with this invention, the several calibrating screws 79 are mounted on the trip arm 97. When the trip device 29 is originally assembled the three calibrating screws 79 are set for each corresponding bimetal element 77 (FIG. 4). Thereafter, to vary or change the thermal rating, it is merely necessary to turn the shaft 113 in order to change the distances between the three calibrating screws 79 and the corresponding bimetal elements 77.

Accordingly, the thermal rating of a multi-pole circuit breaker can be varied from 70% to 100% merely by turning one adjusting member.

What is claimed is:

1. A multi-pole circuit breaker comprising a circuit breaker mechanism having a plurality of pole units, each pole unit comprising a pair of contacts, means releasable when released from a latched position to effect simultaneous opening of all of said pairs of contacts, a multi-pole trip device comprising trip means for each of said pole units, each of said trip means being constructed to operate upon the occurrence of certain current conditions to effect release of said releasable means, each pole unit comprising a bimetal element responsive to current flow to effect heating thereof, trip bar means movable to unlatch the latch lever and being biased in the latched position, the trip bar means comprising a first trip bar and a second trip bar, the first trip bar being mounted to oscillate between latched and unlatched positions, the second trip bar being pivotally mounted on and at spaced locations between the ends of the first trip bar and being pivotally adjustable to simultaneously vary the spacings from the bimetal elements, and adjustment means on one of the first and second trip bars for adjusting the second trip bar with respect to the bi-metal elements.

2. The circuit breaker of claim 1 in which the adjustment means comprises a movable member mounted on one of the first and second trip bars for adjusting the angular position of the other trip bar with respect to said one trip bar.

3. The circuit breaker of claim 2 in which the movable member is mounted on the first trip bar and comprises an enlarged portion that is movable toward and away from the second trip bar to effect changes in the spacing between the second trip bar and the bimetal elements.

4. The circuit breaker of claim 1 in which the adjustment means comprises an adjusting cam.

5. The circuit breaker of claim 4 in which the cam comprises an elongated shaft and an eccentric surface.

6. The circuit breaker of claim 5 in which the elongated shaft is rotatably mounted on the first trip bar and the eccentric surface contacting the second trip bar.

* * * * *

Disclaimer 3,950,716.—*Albert R. Cellerini, Paul Skalka,* and *William I. Stephenson, Jr.,* Beaver, Pa. MULTI-POLE CIRCUIT BREAKER WITH ADJUSTABLE THERMAL TRIP UNIT. Patent dated Apr. 13, 1976. Disclaimer filed July 11, 1978, by the assignee, *Westinghouse Electric Corporation.*

Hereby enters this disclaimer to claims 1–6 of said patent.

[*Official Gazette October 17, 1978.*]